US011260685B2

(12) United States Patent
Shih

(10) Patent No.: US 11,260,685 B2
(45) Date of Patent: Mar. 1, 2022

(54) INK PAD CONTAINER

(71) Applicant: SUN SAME ENTERPRISES CO., LTD., Tainan (TW)

(72) Inventor: Wen Jer Shih, Tainan (TW)

(73) Assignee: SUN SAME ENTERPRISES CO., LTD., Tainan (TW)

( * ) Notice: Subject to any disclaimer, the term of this patent is extended or adjusted under 35 U.S.C. 154(b) by 210 days.

(21) Appl. No.: 16/573,071

(22) Filed: Sep. 17, 2019

(65) Prior Publication Data

US 2021/0008913 A1 Jan. 14, 2021

(30) Foreign Application Priority Data

Jul. 9, 2019 (TW) ..... 108208967

(51) Int. Cl.
*B41K 1/54* (2006.01)
*B41K 1/42* (2006.01)

(52) U.S. Cl.
CPC . *B41K 1/54* (2013.01); *B41K 1/42* (2013.01)

(58) Field of Classification Search
CPC ... B41K 1/02; B41K 1/36; B41K 1/38; B41K 1/40; B41K 1/42; B41K 1/54; A45D 33/006; A45D 40/24
USPC ..... 101/103–110, 327, 333, 334
See application file for complete search history.

(56) References Cited

U.S. PATENT DOCUMENTS

| | | | | | |
|---|---|---|---|---|---|
| 454,499 | A * | 6/1891 | Ryer | B41K 1/40 | 101/334 |
| 2,950,676 | A * | 8/1960 | Weissman | B41K 1/52 | 101/334 |
| 3,359,897 | A * | 12/1967 | Harte | B41K 1/10 | 101/334 |
| 6,945,172 | B1 * | 9/2005 | Shih | B41K 1/42 | 101/103 |
| 7,389,727 | B2 * | 6/2008 | Faber | B41K 1/40 | 101/334 |
| 8,931,407 | B2 * | 1/2015 | Shih | B41K 1/42 | 101/334 |
| 9,884,502 | B2 * | 2/2018 | Faber | B41K 1/006 | |
| 10,654,302 | B2 * | 5/2020 | Scharinger | B41K 1/40 | |
| 10,773,538 | B2 * | 9/2020 | Shih | B41K 1/54 | |
| 2011/0277647 | A1 * | 11/2011 | Zindl | B41K 1/42 | 101/334 |
| 2014/0196622 | A1 * | 7/2014 | Shih | B41K 1/40 | 101/333 |

* cited by examiner

*Primary Examiner* — Matthew G Marini
*Assistant Examiner* — Marissa Ferguson-Samreth
(74) *Attorney, Agent, or Firm* — Tracy M Heims; Apex Juris, pllc.

(57) ABSTRACT

An ink pad container is detachably disposed on a fixing seat of a stamp and has a body. The body has a chamber formed in the body, a bottom surface, two opposite side surfaces, a front surface, an opening formed in the bottom surface of the body and communicating with the chamber, two positioning portions formed in the two opposite side surfaces of the body respectively, a front recess formed in the front surface of the body, a front stopper formed across the front recess of the body, and a front guiding groove formed between the front stopper and the front recess. The replacement of the ink pad container is made convenient and stable by the front stopper with single-point forcing.

15 Claims, 19 Drawing Sheets

INK PAD CONTAINER

This application claims the priority of Taiwan patent application No. 108208967, filed on Jul. 9, 2019.

BACKGROUND OF THE INVENTION

1. Field of the Invention

The present invention relates to an ink pad container, and more particularly to an ink pad container that can be easily forced to detach from a stamp and moves steadily.

2. Description of Related Art

For replacing an ink pad container of a conventional stamp easily, the conventional stamp has a fixing seat, a moving seat, a recovery member, a printing member, and the ink pad container. The fixing seat has a space formed in the fixing seat, an inner front opening formed in a front surface of the fixing seat, and two inner side openings respectively formed in two side surfaces of the fixing seat. The inner front opening and the two inner side openings all communicate with the space. The inner front opening directly communicates with the two inner side openings. The moving seat is disposed on the fixing seat and has an outer front opening and two outer side openings. The outer front opening of the moving seat is formed in a front surface of the moving seat and communicates with the inner front opening of the fixing seat. The two outer side openings are respectively formed in two side surfaces of the moving seat, both directly communicate with the outer front opening, and respectively communicate with the inner side openings of the fixing seat. The recovery member is disposed between the fixing seat and the moving seat. The printing member is located in the space of the fixing seat and is controlled by the moving seat. The ink pad container is inserted into the space of the fixing seat. The ink pad container has a body and two clipping elements. The two clipping elements are respectively disposed on two side surfaces of the body adjacent to a front surface of the body, are respectively located in the two inner side openings of the fixing seat, and are respectively exposed out of the outer side openings of the moving seat.

When replacing the ink pad container, a thumb and a second finger of a user are respectively inserted into the two outer side openings for catching the two clipping elements of the ink pad container simultaneously. The two clipping elements are pulled simultaneously. The body of the ink pad container moves out of the inner front opening of the fixing seat and the outer front opening of the moving seat for replacing the ink pad container conveniently.

However, the two clipping elements are simultaneously clipped and forced by the user to form two-point forcing. In the two-point forcing, the forces applied on the two clipping elements are difficult to keep equal. When the forces applied on the two clipping elements are different, the ink pad container may be rotated and stuck in the fixing seat. Therefore, the replacement of the ink pad container is inconvenient and unstable.

Moreover, the two clipping elements of the ink pad container are disposed on the two side surfaces of the body. The fixing seat has the two inner side openings and the moving seat has the two outer side openings in accordance with the two clipping elements. Therefore, the ink pad container cannot be applied to the moving seat without the two outer side openings and the fixing seat without the two inner side openings, so the applicability of the ink pad container is not good.

To overcome the shortcomings, the present invention provides an ink pad container to mitigate or obviate the aforementioned problems.

SUMMARY OF THE INVENTION

The objective of the invention is to provide an ink pad container that can solve the shortcoming that the forces applied on the two clipping elements of the conventional ink pad container are difficult to keep equal, the replacement of the conventional ink pad container is inconvenient and unstable, and the applicability of the conventional ink pad container is not good.

The ink pad container is detachably disposed on a fixing seat of a stamp and has a body. The body has a chamber formed in the body, a bottom surface, two opposite side surfaces, a front surface, an opening formed in the bottom surface of the body and communicating with the chamber, two positioning portions formed in the two opposite side surfaces of the body respectively, a front recess formed in the front surface of the body, a front stopper formed across the front recess of the body, and a front guiding groove formed between the front stopper and the front recess.

Furthermore, the body has a rear surface, a rear recess formed in the rear surface of the body, a rear stopper formed across the rear recess of the body opposite to the front stopper, and a rear guiding groove formed between the rear stopper and the rear recess.

The ink pad container is applied to a first embodiment of the stamp. The fixing seat of the stamp has a front insertion opening. The front insertion opening is formed in a front surface of the fixing seat and is exposed out of the stamp. The ink pad container is inserted into the fixing seat via the front insertion opening of the fixing seat. The front stopper of the body is exposed out of the front insertion opening of the fixing seat. To replace the body, a nail of a user is inserted into the front guiding groove and abuts an inner edge of the front stopper for forcing to pull out the body.

The ink pad container is applied to a second embodiment of the stamp. The fixing seat of the stamp has the front insertion opening formed in the front surface of the fixing seat and a rear insertion opening formed in a rear surface of the fixing seat. The front insertion opening and the rear insertion opening are both exposed out of the stamp. During replacement, a finger of the user can force on an outer surface of the rear stopper of the body via the rear insertion opening, so that the body can be protruded out of the front insertion opening slightly, and then the nail of the user can be inserted into the front guiding groove and abut the inner edge of the front stopper for forcing to pull out the body. Alternatively, the nail of the user can be inserted into the front guiding groove and abut the inner edge of the front stopper for forcing to pull out the body without firstly forcing on the outer surface of the rear stopper.

The ink pad container is applied to a third embodiment of the stamp. The fixing seat of the stamp has the front insertion opening formed in a front surface of the fixing seat and a rear insertion opening formed in a rear surface of the fixing seat. The front insertion opening and the rear insertion opening are both exposed out of the stamp. The rear insertion opening is covered by a moving seat of the stamp. During replacement, the user can push the outer surface of the rear stopper of the body by a pushing device disposed on the moving seat, so that the body can be protruded out of the front insertion opening slightly, and then the nail of the user can be inserted into the front guiding groove and abut the inner edge of the front stopper for forcing to pull out the body. Alternatively, the nail of the user can be inserted into the front guiding groove and abut the inner edge of the front stopper for forcing to pull out the body without forcing on the outer surface of the rear stopper.

As abovementioned, the single front stopper is formed on the front surface of the body for removing the body with a single-point forcing. In the single-point forcing, there is no need for equal force distribution as in the two-point forcing. The single-point forcing can eliminate the rotation caused by the different forces in the two-point forcing. The replacement of the ink pad container is convenient and stable. In addition, the ink pad container can be applied to multiple embodiments of the stamps, so the applicability of the ink pad container is good.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
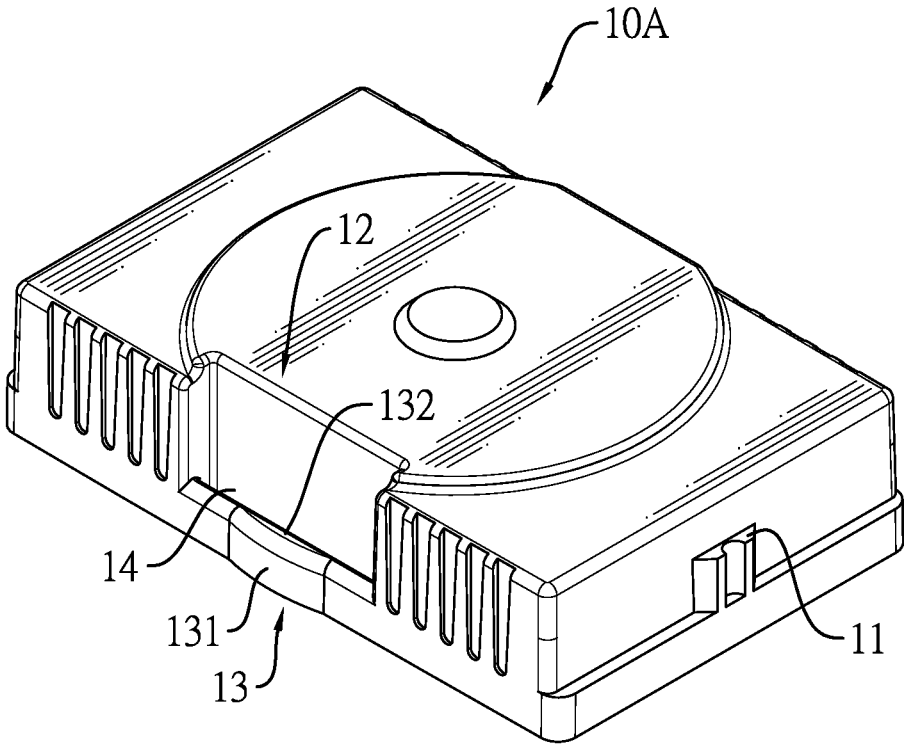
FIG. 1 is a perspective view of a first embodiment of an ink pad container in accordance with the present invention.
Figure 2:
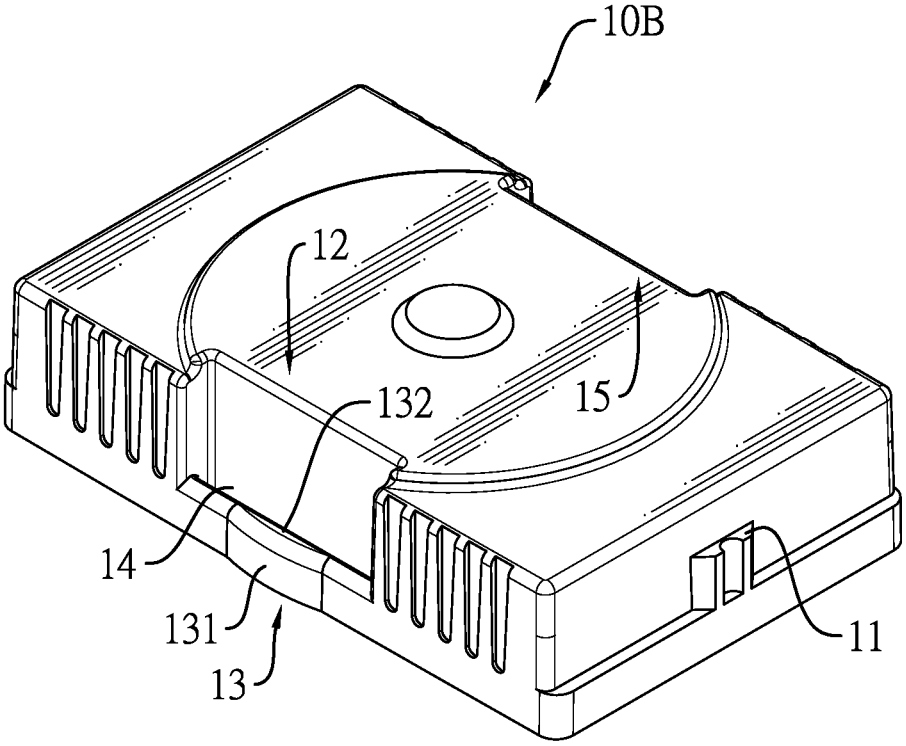
FIG. 2 is a perspective view of a second embodiment of an ink pad container in accordance with the present invention.

With reference to FIGS. 9, 11, 17, and 18, an ink pad container in accordance with the present invention is detachably disposed on a fixing seat 21 of a stamp 21, 20', 20". With reference to FIGS. 1 to 8, and 10, the ink pad container has a body 10A, 10B, 10C, 10D, 10E, 10F. The body 10A, 10B, 10C, 10D, 10E, 10F has a bottom surface, a front surface, two opposite side surfaces, a chamber 101, an opening 102, two positioning portions 11, a front recess 12, a front stopper 13, and a front guiding groove 14. The chamber 101 is formed in the body 10A, 10B, 10C, 10D, 10E, 10F. The opening 102 is formed in the bottom surface of the body 10A, 10B, 10C, 10D, 10E, 10F and communicates with the chamber 101. The two positioning portions 11 are formed in the two opposite side surfaces of the body 10A, 10B, 10C, 10D, 10E, 10F respectively. The front recess 12 is formed in the front surface of the body 10A, 10B, 10C, 10D, 10E, 10F. The front stopper 13 is formed across the front recess 12 of the body 10A, 10B, 10C, 10D, 10E, 10F. The front guiding groove 14 is formed between the front stopper 13 and the front recess 12.

Figure 8:
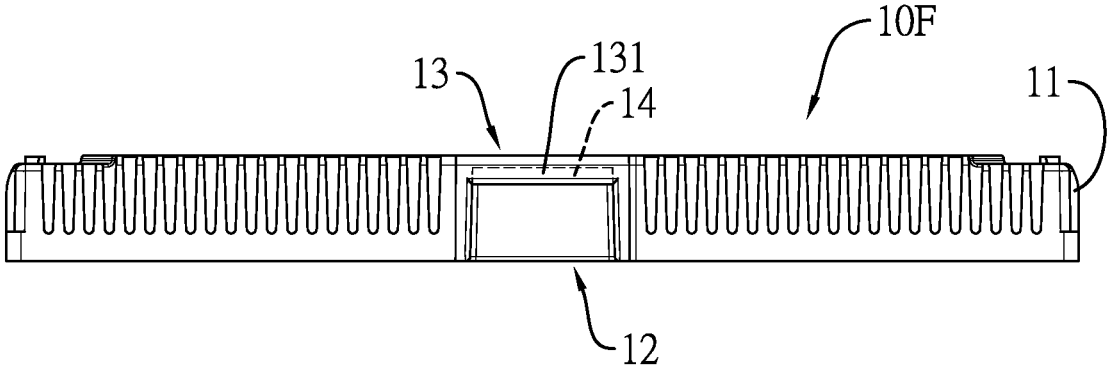
FIG. 8 is a front view of a sixth embodiment of an ink pad container in accordance with the present invention.

Furthermore, the front stopper 13 is located at a middle of the front surface of the body 10A, 10B, 10C, 10D, 10E, 10F, or two ends of the front stopper 13 are respectively adjacent to the two opposite side surfaces of the body 10A, 10B, 10C, 10D, 10E, 10F. With reference to FIGS. 1 and 8, the front stopper 13 is adjacent to a top surface or the bottom surface of the body 10A, 10F.

The body 10B, 10C, 10D, 10E, 10F has a rear surface, a rear recess 15, a rear stopper 16, and a rear guiding groove 17. The rear recess 15 is formed in the rear surface of the body 10B, 10C, 10D, 10E, 10F. The rear stopper 16 is formed across the rear recess 15 of the body 10B, 10C, 10D, 10E, 10F opposite to the front stopper 13. The rear guiding groove 17 is formed between the rear stopper 16 and the rear recess 15.

Furthermore, the rear stopper 16 is located at a middle of the rear surface of the body 10B, 10C, 10D, 10E, 10F, or two ends of the rear stopper 16 are respectively adjacent to the two opposite side surfaces of the body 10B, 10C, 10D, 10E, 10F. In addition, the rear stopper 16 is adjacent to a top surface or the bottom surface of the body 10B, 10C, 10D, 10E, 10F.

Figure 3:
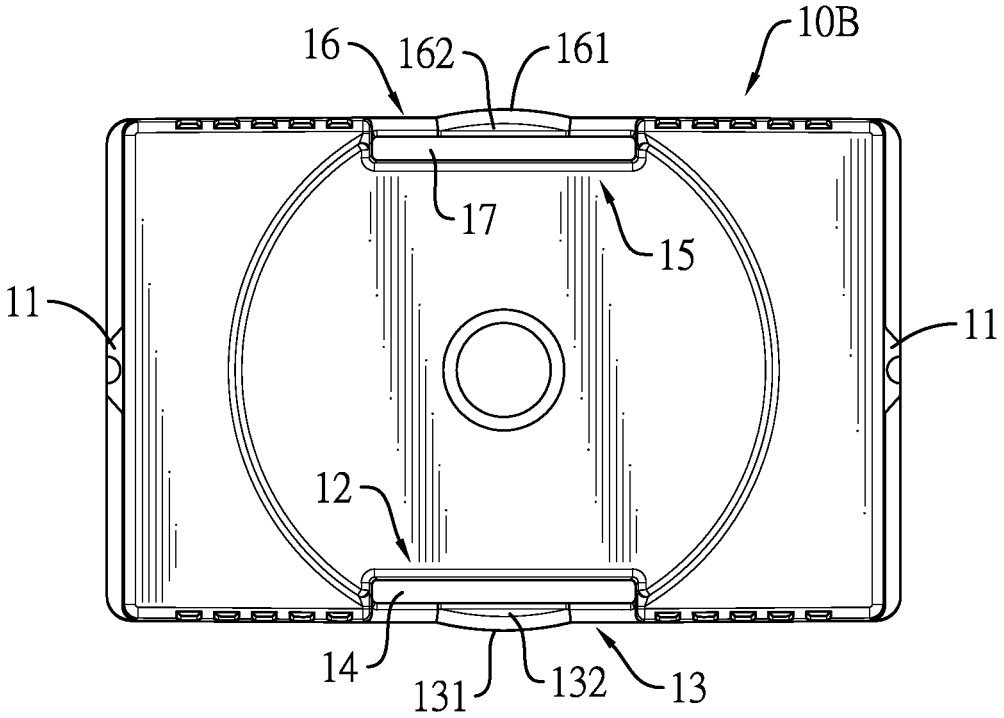
FIG. 3 is a top view of the ink pad container in FIG. 2.
Figure 4:
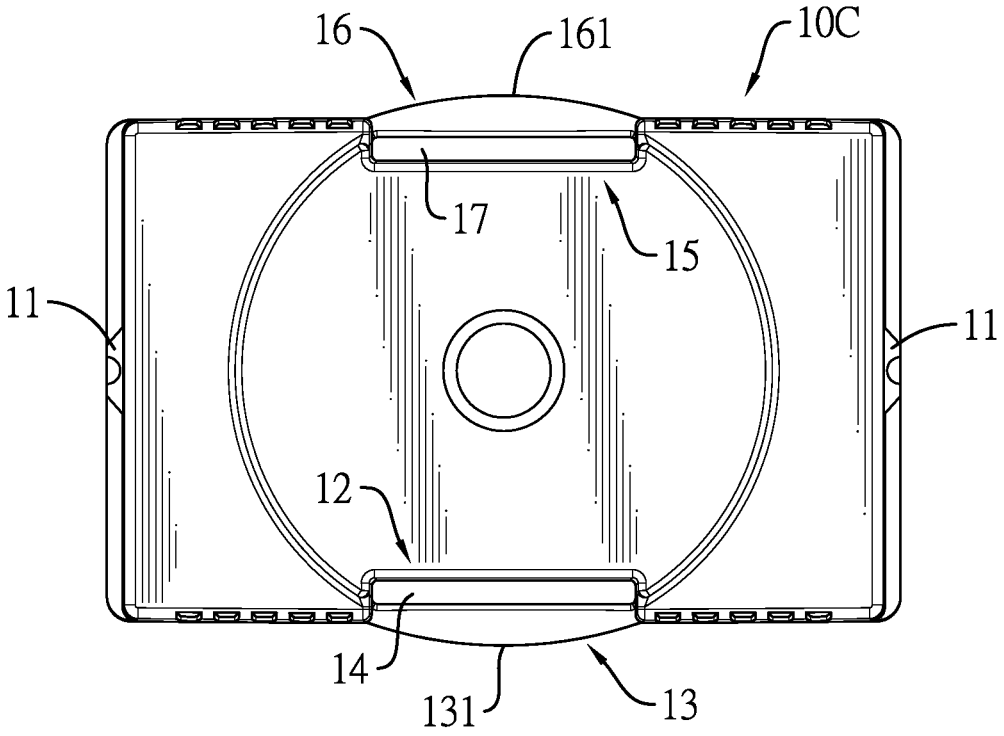
FIG. 4 is a top view of a third embodiment of an ink pad container in accordance with the present invention.
Figure 5:
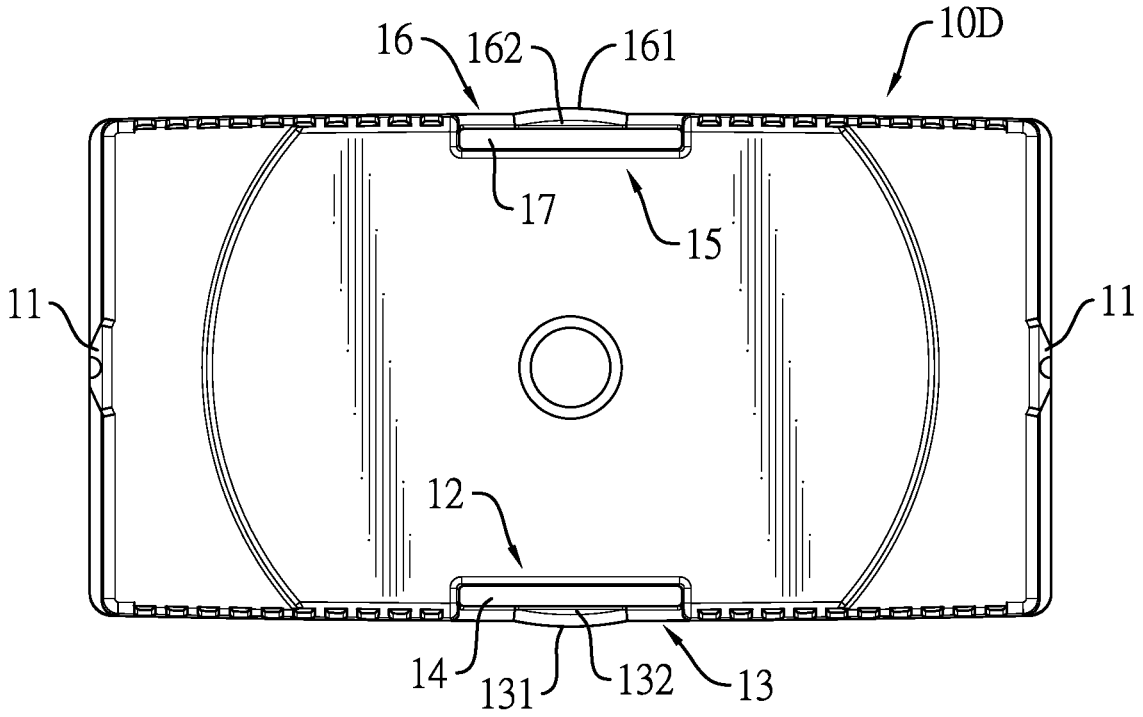
FIG. 5 is a top view of a fourth embodiment of an ink pad container in accordance with the present invention.
Figure 6:
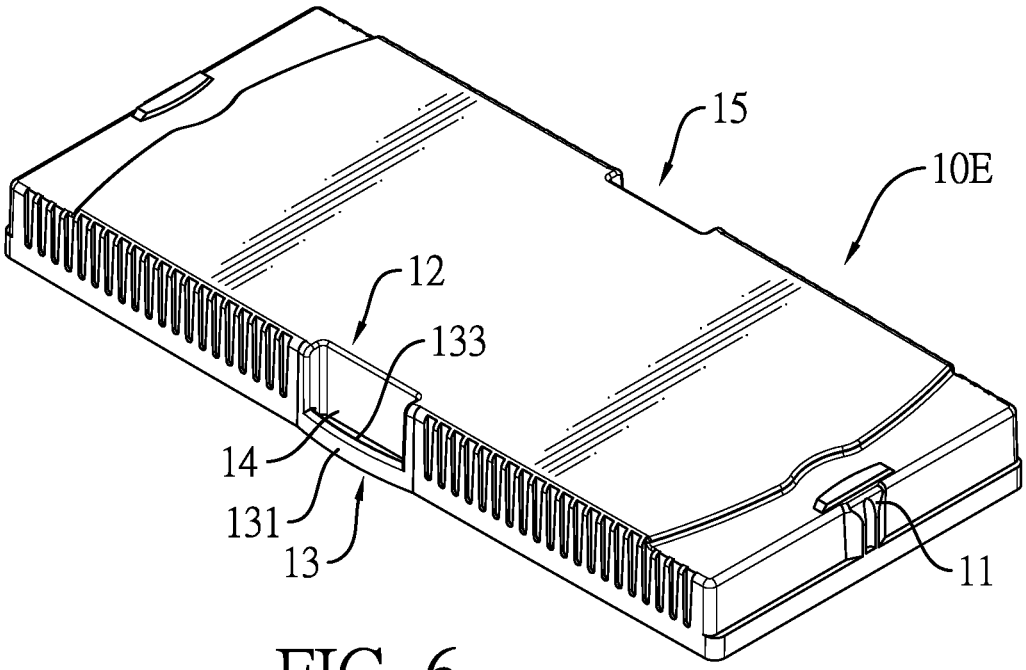
FIG. 6 is a perspective view of a fifth embodiment of an ink pad container in accordance with the present invention.
Figure 7:
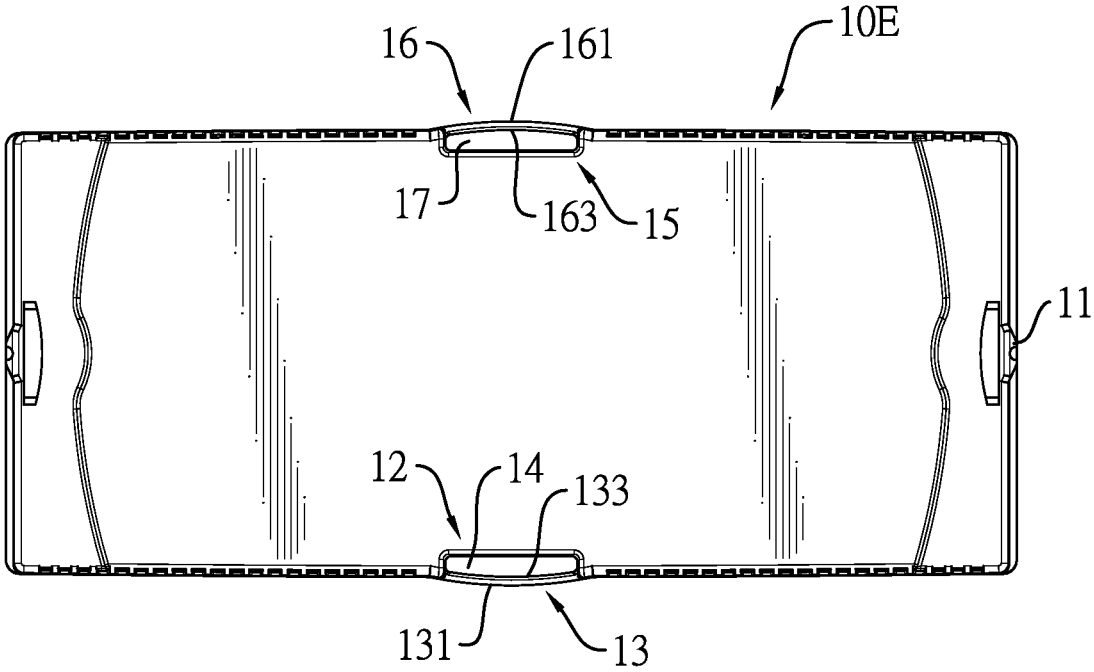
FIG. 7 is a top view of the ink pad container in FIG. 6.

With reference to FIGS. 3, 4, 5, and 7, the front stopper 13 has a first convex surface 131 formed on an outer surface of the front stopper 13, and the rear stopper 16 has a second convex surface 161 formed on an outer surface of the rear stopper 16. With reference to FIGS. 3 and 5, the first convex surface 131 is located at a middle of the outer surface of the front stopper 13, and the second convex surface 161 is located at a middle of the outer surface of the rear stopper 16. With reference to FIGS. 4 and 7, two ends of the first convex surface 131 are respectively adjacent to the two ends of the front stopper 13. Two ends of the second convex surface 161 are respectively adjacent to the two ends of the rear stopper 16.

With reference to FIGS. 3 and 5, the front stopper 13 has a first guiding surface 132 formed on an inner surface of the front stopper 13. The first guiding surface 132 is inclined outwardly with respect to the body 10A. The rear stopper 16 has a second guiding surface 162 formed on an inner surface of the rear stopper 16. The second guiding surface 162 is inclined outwardly with respect to the body 10A. The inner surface of the front stopper 13 is flat. With reference to FIG. 7, the front stopper 13 has a first concave surface 133 formed on the inner surface of the front stopper 13 opposite the first convex surface 131. The rear stopper 16 has a second concave surface 163 formed on an inner surface of the rear stopper 16 opposite the second convex surface 161.

Figure 9:
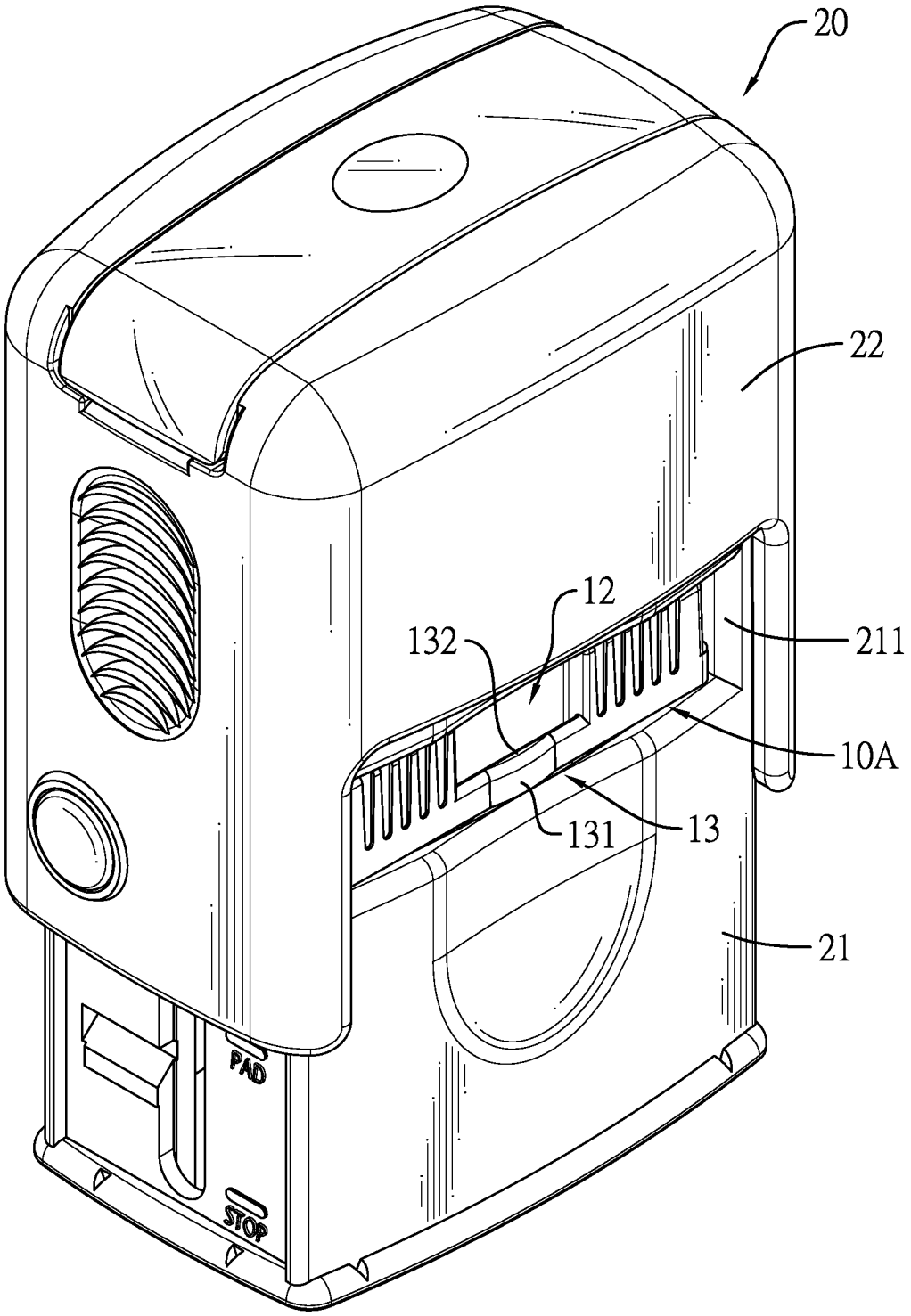
FIG. 9 is an operational perspective view of the ink pad container in FIG. 1 showing that the ink pad container is disposed in a first embodiment of a stamp.
Figure 10:
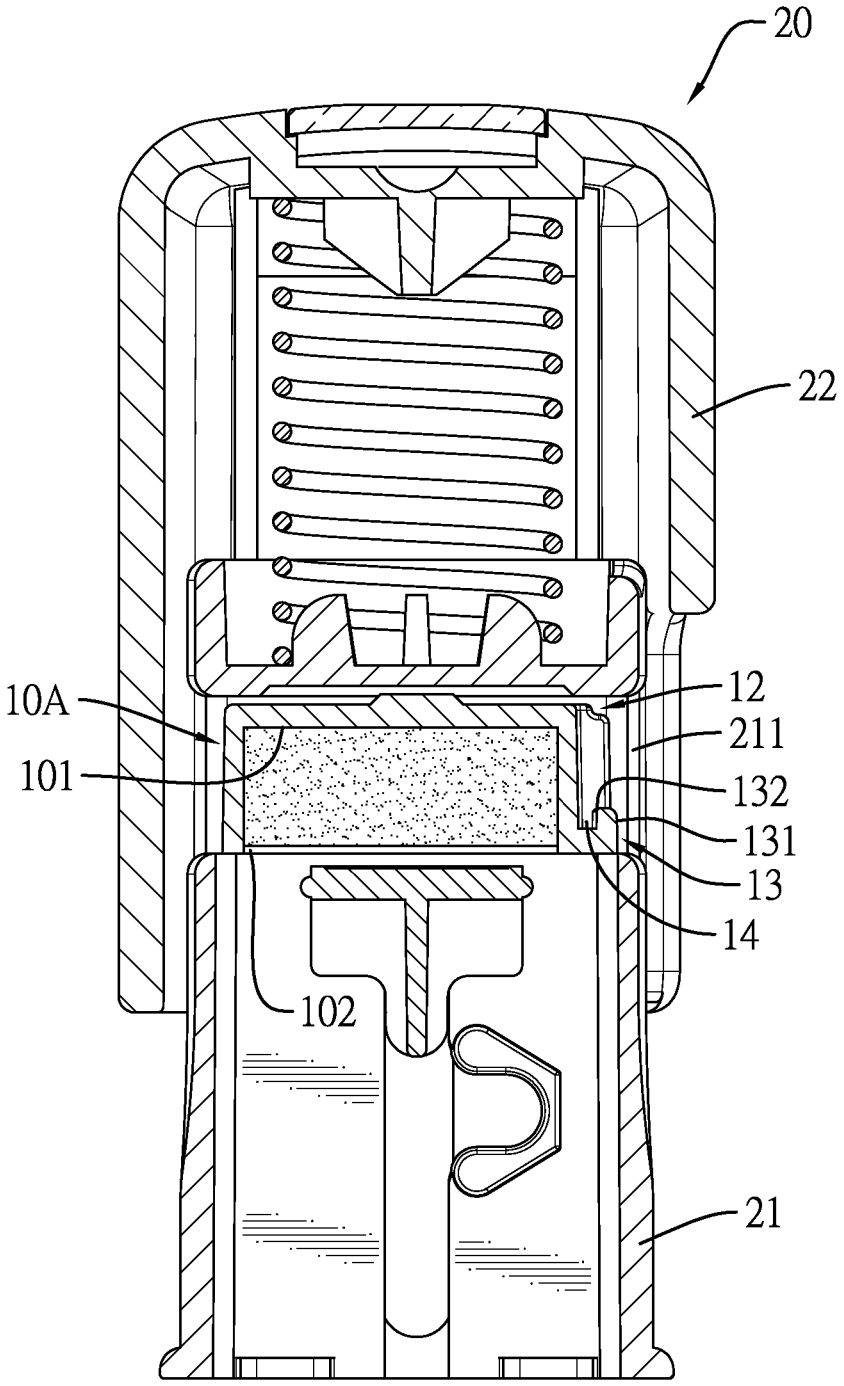
FIG. 10 is a cross sectional side view of the stamp in FIG. 9.
Figure 15:
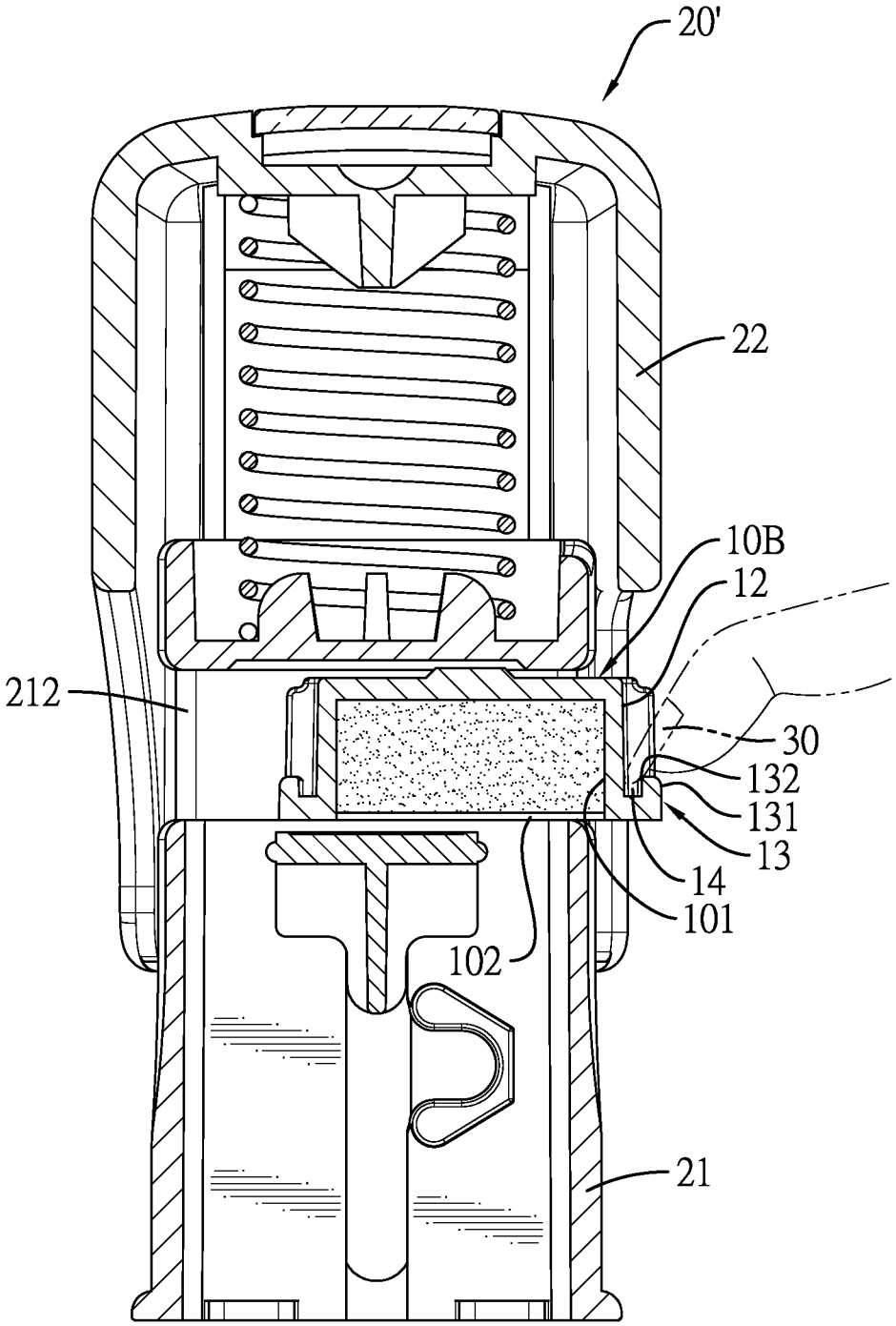
FIG. 15 is an operational cross sectional side view of the stamp in FIG. 14 showing that a body of the ink pad container is pulled.

With reference to FIGS. 9 and 10, the ink pad container is applied to a first embodiment of the stamp 20. The fixing seat 21 of the stamp 20 has a front insertion opening 211. The front insertion opening 211 is formed in a front surface of the fixing seat 21 and is exposed out of the stamp 20. The ink pad container is inserted into the fixing seat 21 via the front insertion opening 211 of the fixing seat 21 and is positioned in the fixing seat 21 by the positioning portions 11 of the body 10A. The front stopper 13 of the body 10A is exposed out of the front insertion opening 211 of the fixing seat 21. To replace the ink pad container, a nail 30 of a user as shown in FIG. 15 is inserted into the front guiding groove 14 and abuts the first guiding surface 132 of the front stopper 13. A pulling force is forced on the first guiding surface 132 for pulling out the body 10A with single-point forcing. The ink pad is easy to be detached from the fixing seat 21. The replacement of the ink pad container is convenient and stable.

Figure 11:
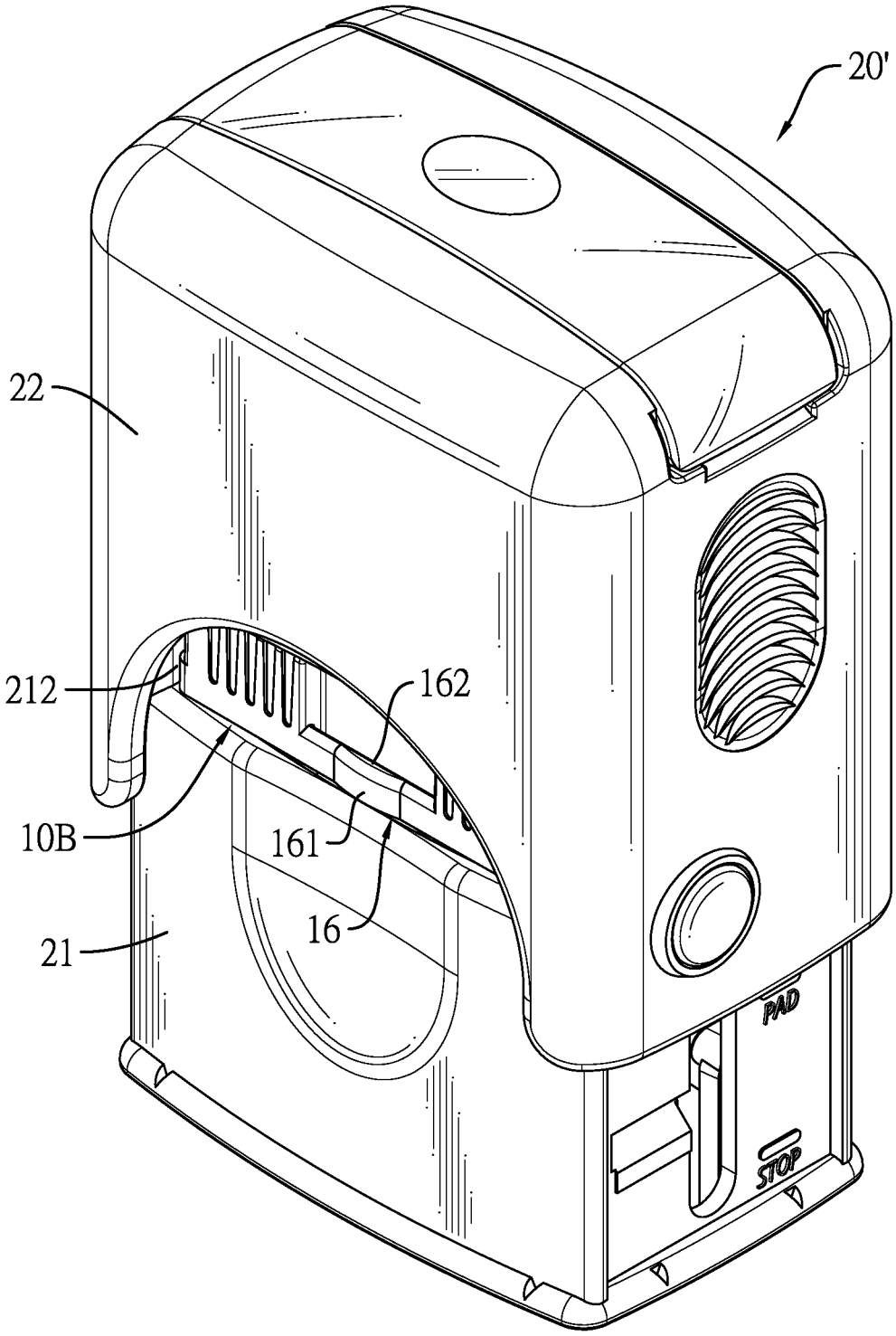
FIG. 11 is an operational perspective view of the ink pad container in FIG. 2 showing that the ink pad container is disposed in a second embodiment of the stamp.
Figure 12:
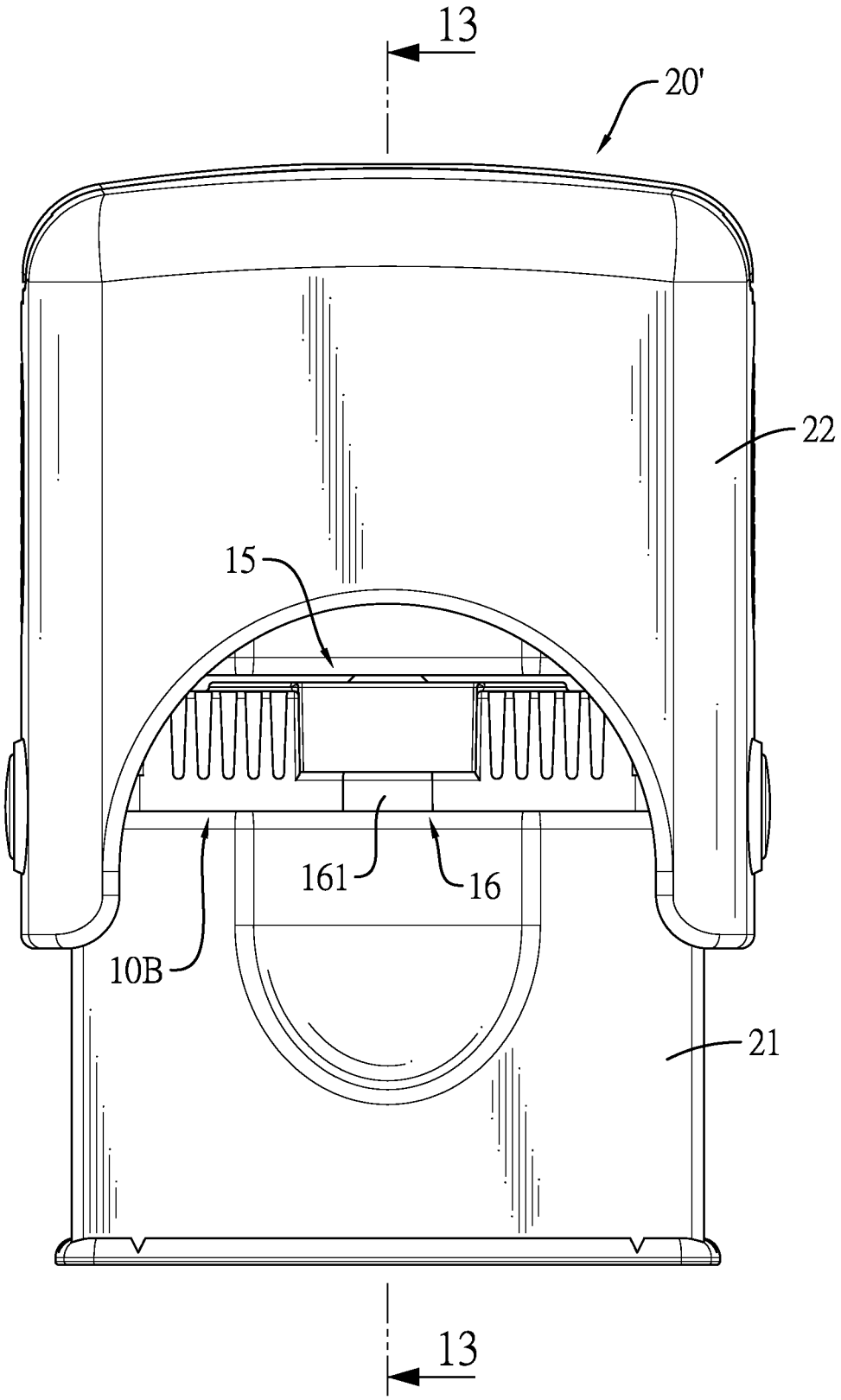
FIG. 12 is a rear view of the stamp in FIG. 11.
Figure 13:
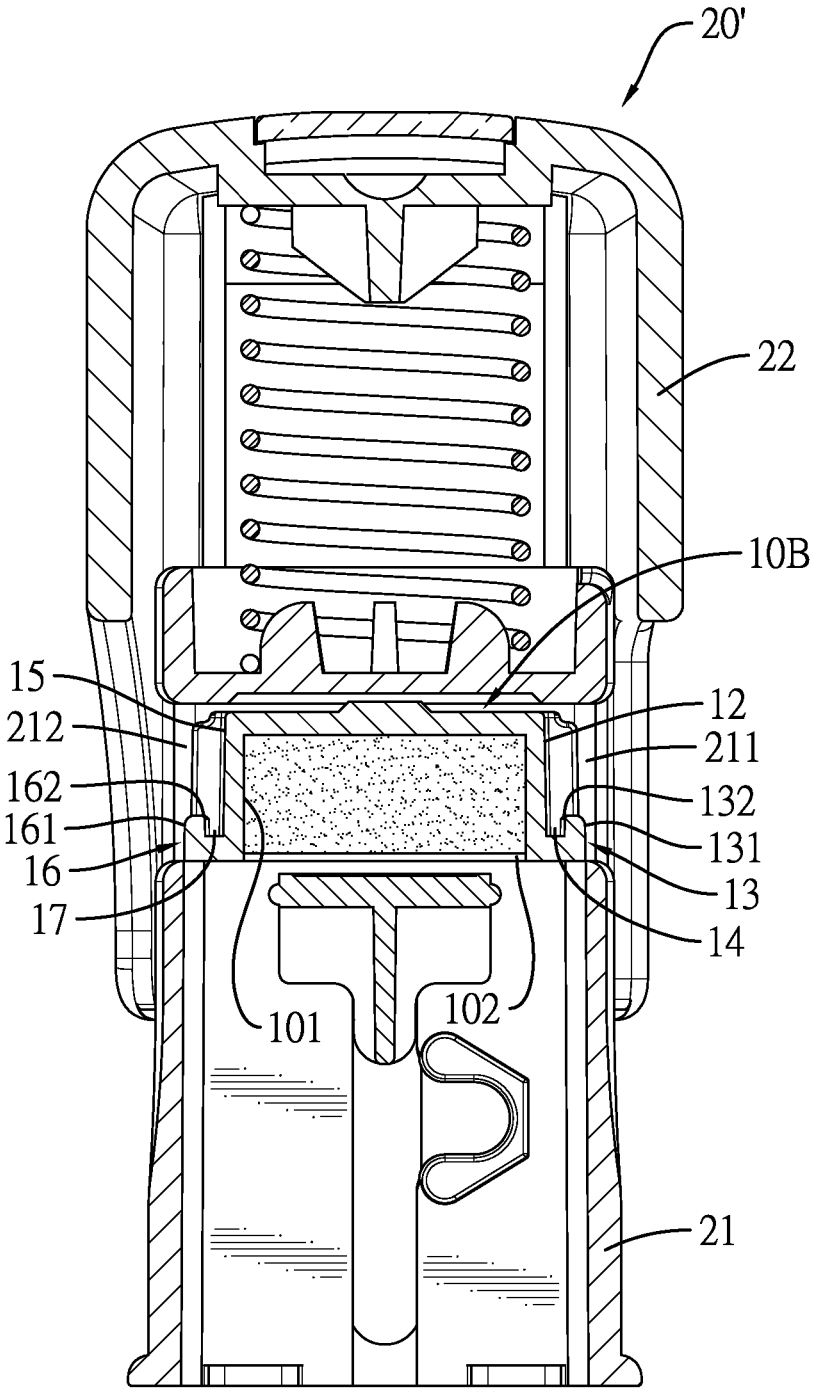
FIG. 13 is a cross sectional side view of the stamp along line 13-13 in FIG. 12.

With reference to FIGS. 11 to 13, the ink pad container is applied to a second embodiment of the stamp 20'. The fixing seat 21 of the stamp 20' has the front insertion opening 211 formed in the front surface of the fixing seat 21 and a rear insertion opening 212 formed in a rear surface of the fixing seat 21. The front insertion opening 211 and the rear insertion opening 212 of the fixing seat 21 are both exposed out of the stamp 20'. The ink pad container is inserted into the fixing seat 21 via the front insertion opening 211 of the fixing seat 21 and is positioned in the fixing seat 21 by the positioning portions 11 of the body 10B. The front stopper 13 of the body 10B is exposed out of the front insertion opening 211 of the fixing seat 21. The rear stopper 16 of the body 10B is exposed out of the rear insertion opening 212 of the fixing seat 21.

Figure 14:
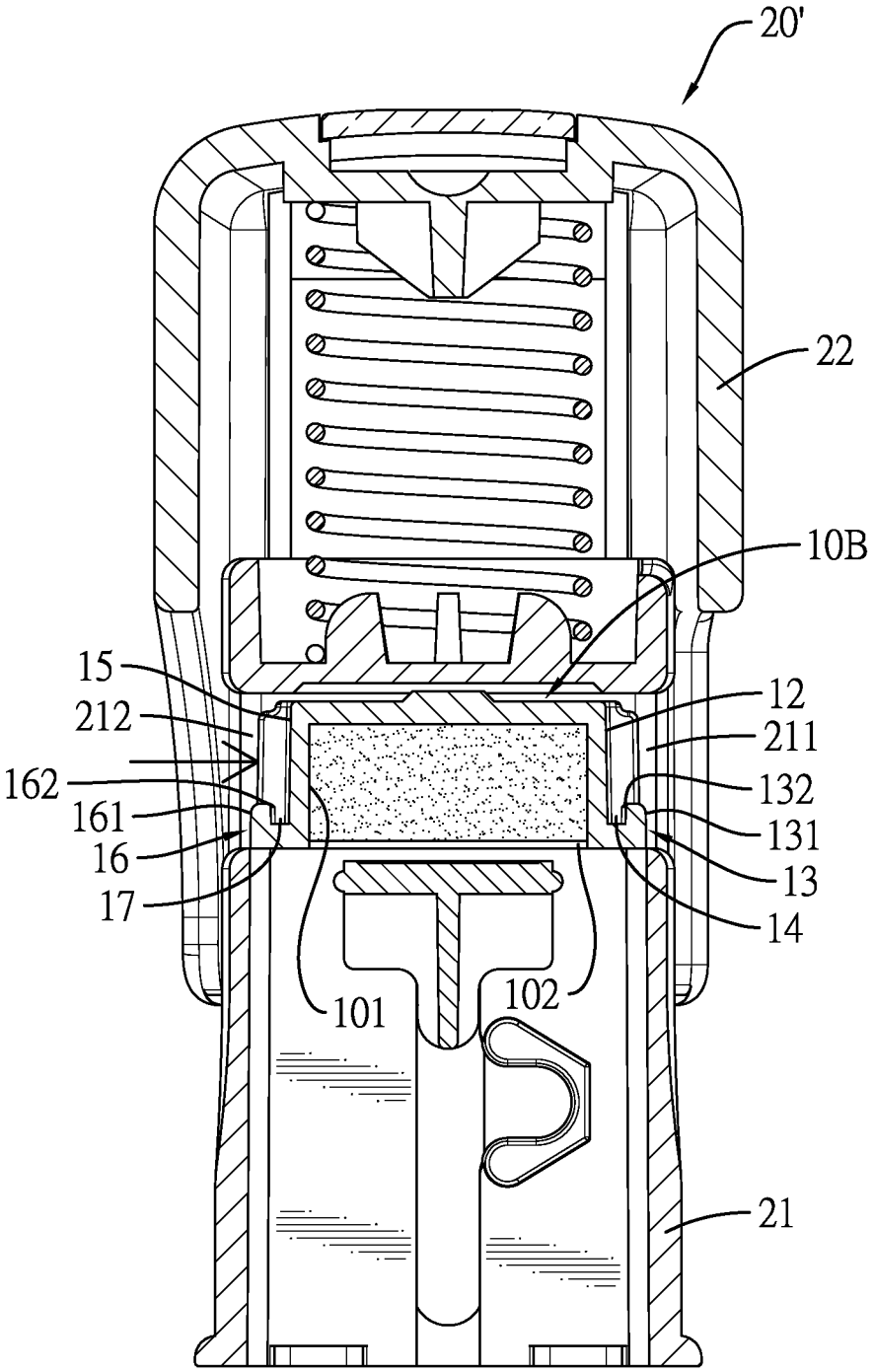
FIG. 14 is an operational cross sectional side view of the stamp in FIG. 13 showing that a body of the ink pad container is pushed.

With reference to FIGS. 14 and 15, during replacement, a finger of the user can force on the second convex surface 161 of the rear stopper 16 via the rear insertion opening 212, so that the body 10B can be protruded out of the front insertion opening slightly, and then the nail 30 of the user can be inserted into the front guiding groove 14 and abuts the first guiding surface 132 of the front stopper 13. The pulling force is forced on the first guiding surface 132 for pulling out the body 10B with the single-point forcing. The ink pad is easy to be detached from the fixing seat 21. The replacement of the ink pad container is convenient and stable.

Figure 16:
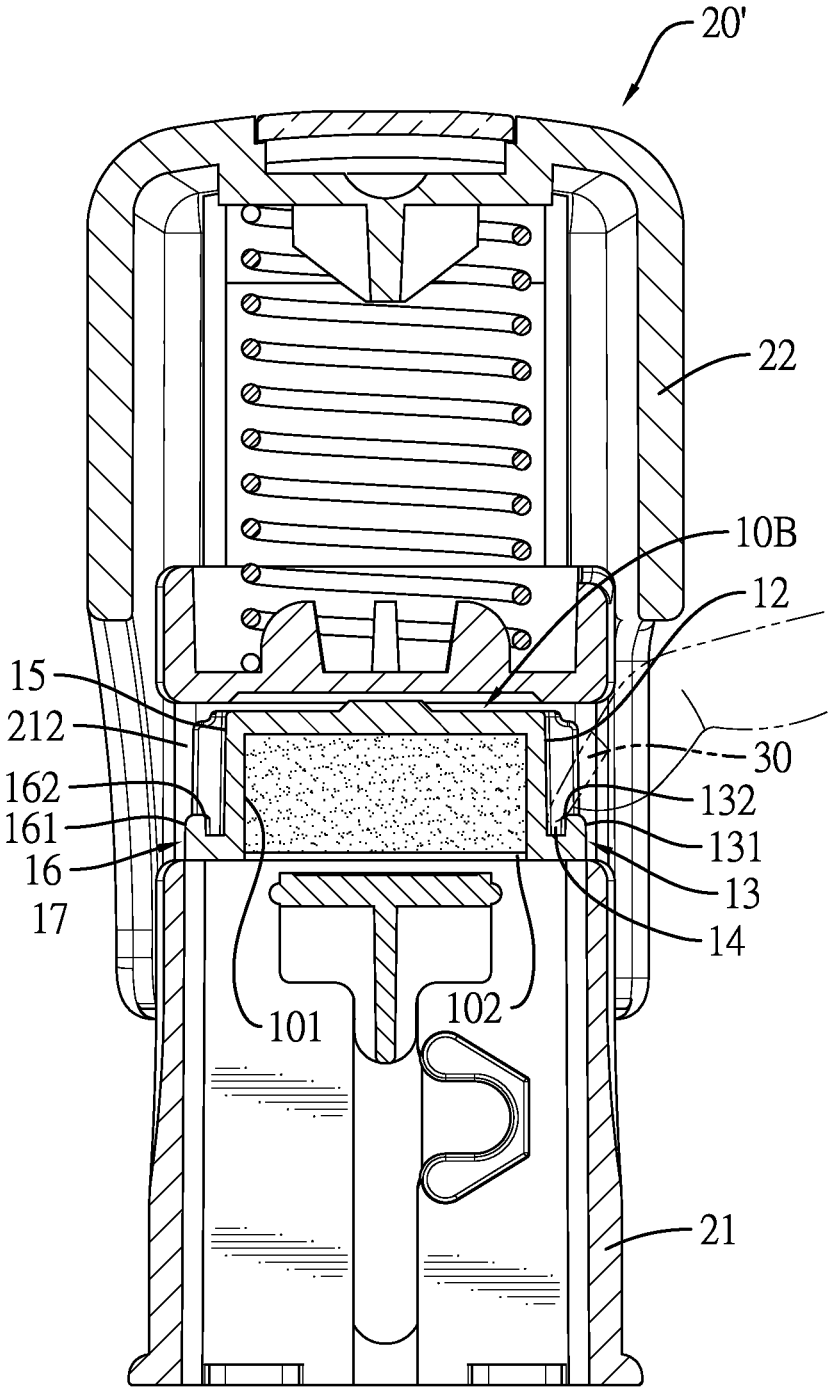
FIG. 16 is another operational cross sectional side view of the stamp in FIG. 13 showing that a body of the ink pad container is pulled.

Alternatively, with reference to FIG. 16, the nail 30 of the user can be inserted into the front guiding groove 14 and abuts the first guiding surface 132 of the front stopper 13 for forcing to pull out the body 10B without firstly forcing on the second convex surface 161 of the rear stopper 16. The amount of the movement of the body 10B moving out of the front insertion opening 211 is increased by the single-point forcing. The ink pad is easy to be detached from the fixing seat 21. The replacement of the ink pad container is convenient and stable.

Figure 17:
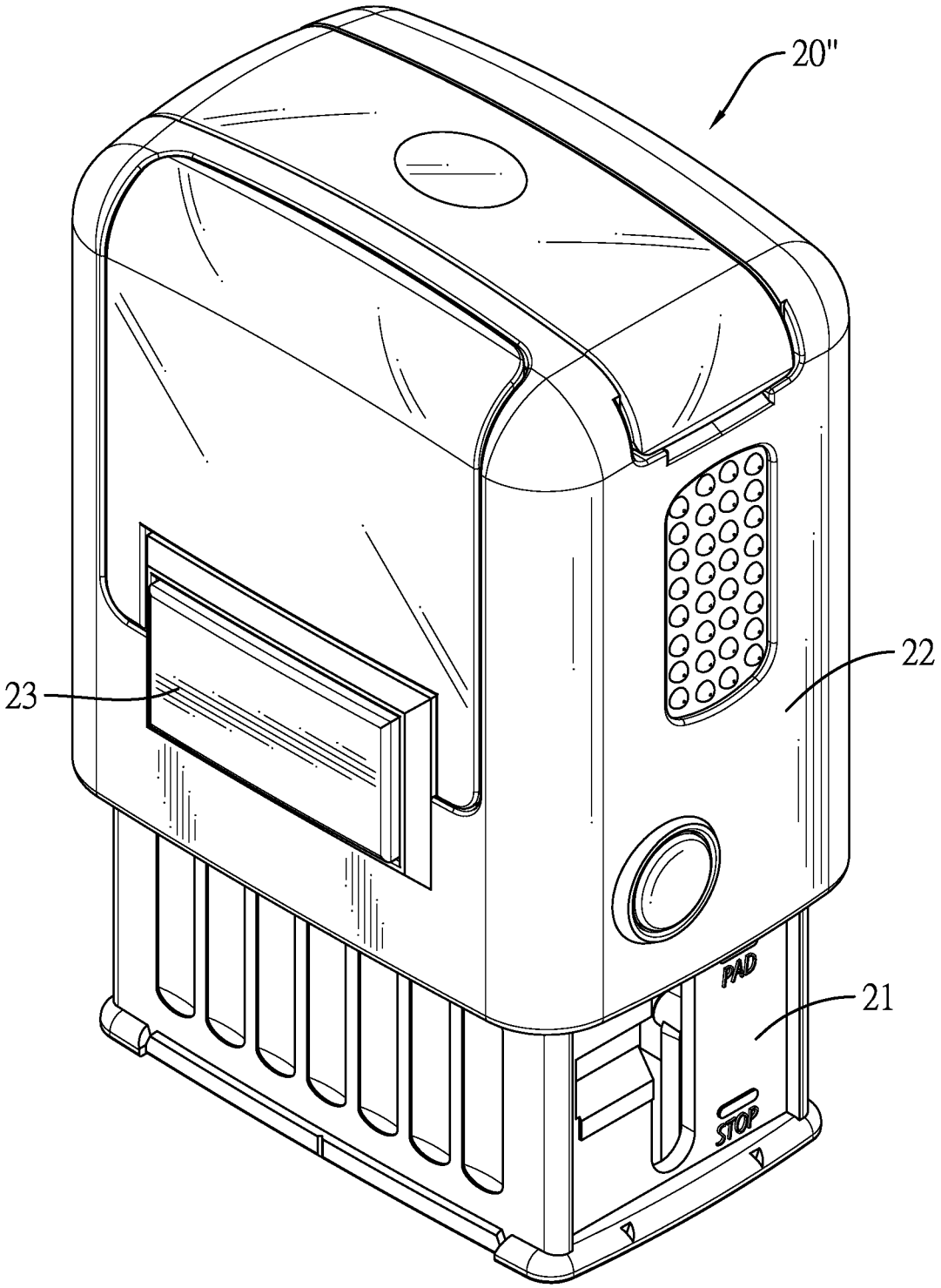
FIG. 17 is an operational perspective view of the ink pad container in FIG. 2 showing that the ink pad container is disposed in a third embodiment of the stamp.
Figure 18:
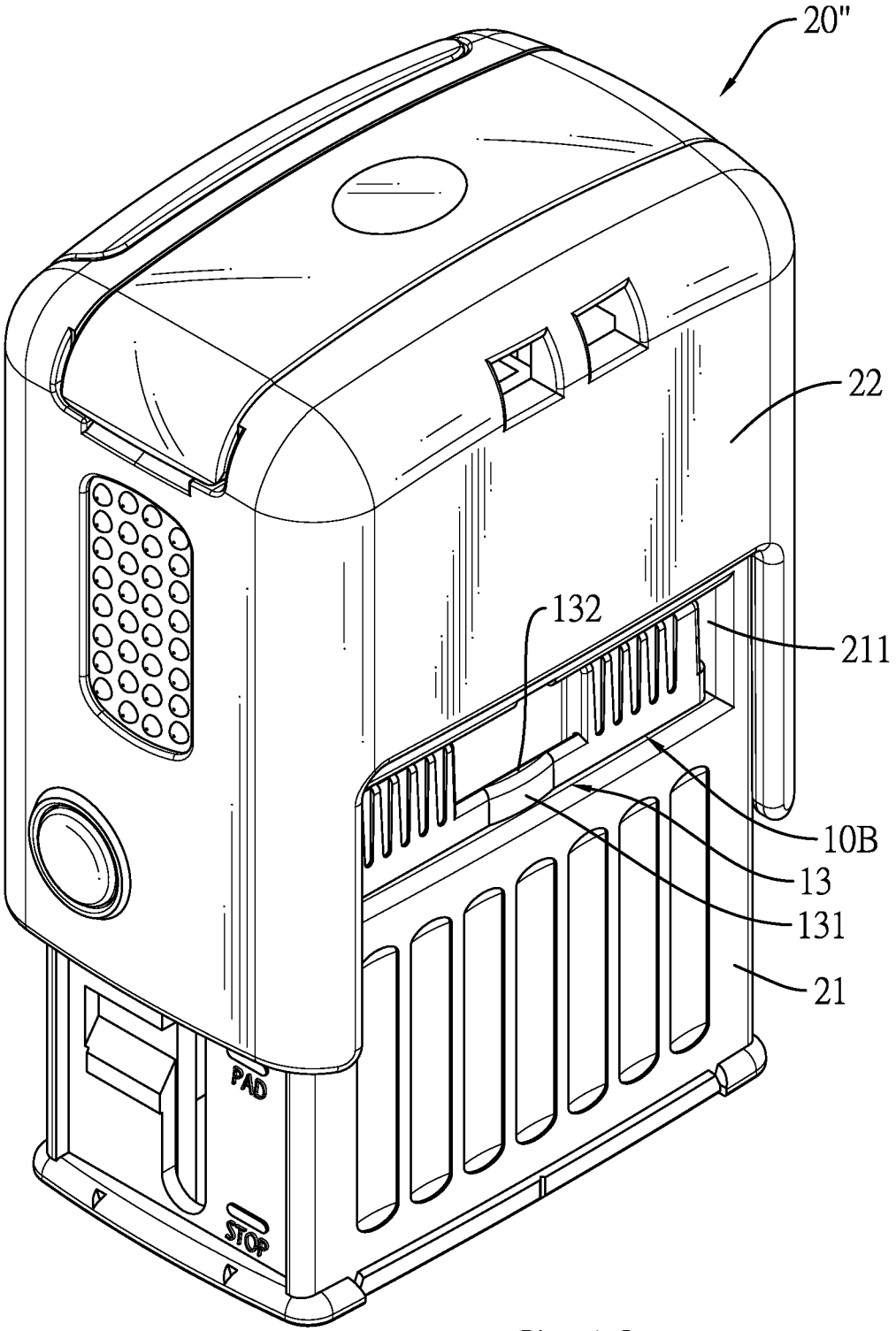
FIG. 18 is another operational perspective view of the ink pad container in FIG. 2 showing that the ink pad container is disposed in a third embodiment of a stamp.
Figure 19:
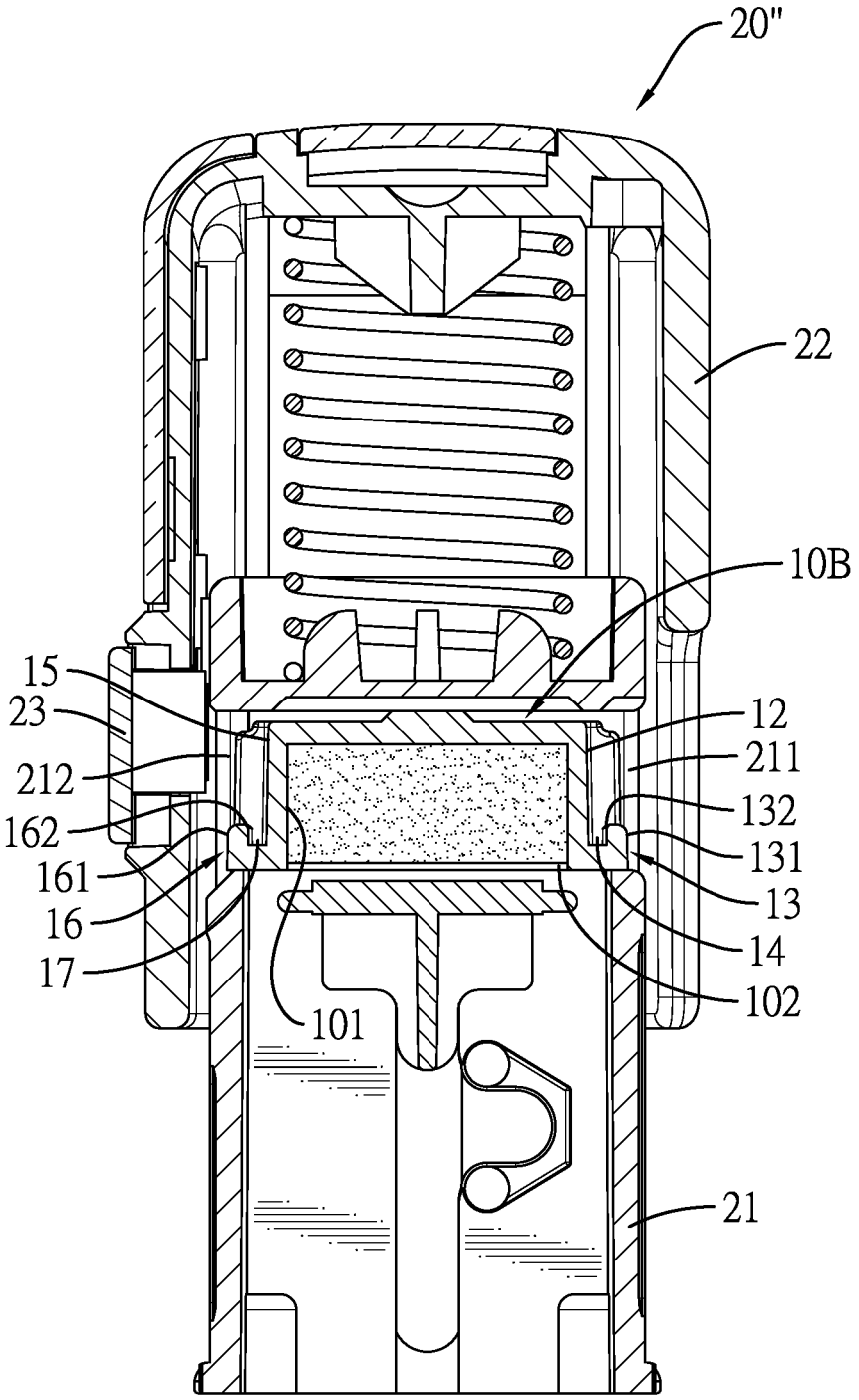
FIG. 19 is a cross sectional side view of the stamp in FIG. 17.

With reference to FIGS. 17 to 19, the ink pad container is applied to a third embodiment of the stamp 20". The fixing seat 21 of the stamp 20" has the front insertion opening 211 formed in the front surface of the fixing seat 21 and a rear insertion opening 212 formed in the rear surface of the fixing seat 21. The front insertion opening 211 of the fixing seat 21 is exposed out of the stamp 20". The rear insertion opening 212 is covered by a moving seat 22 of the stamp 20". The stamp 20" has a pushing device 23 disposed on the moving seat 22. The ink pad container is inserted into the fixing seat 21 via the front insertion opening 211 of the fixing seat 21 and is positioned in the fixing seat 21 by the positioning portions 11 of the body 10B. The front stopper 13 of the body 10B is exposed out of the front insertion opening 211 of the fixing seat 21. The rear stopper 16 of the body 10B is exposed out of the rear insertion opening 212 of the fixing seat 21. The pushing device 23 can move with the moving seat 22 and faces the second convex surface 161 of the rear stopper 16 of the body 10B.

Figure 20:
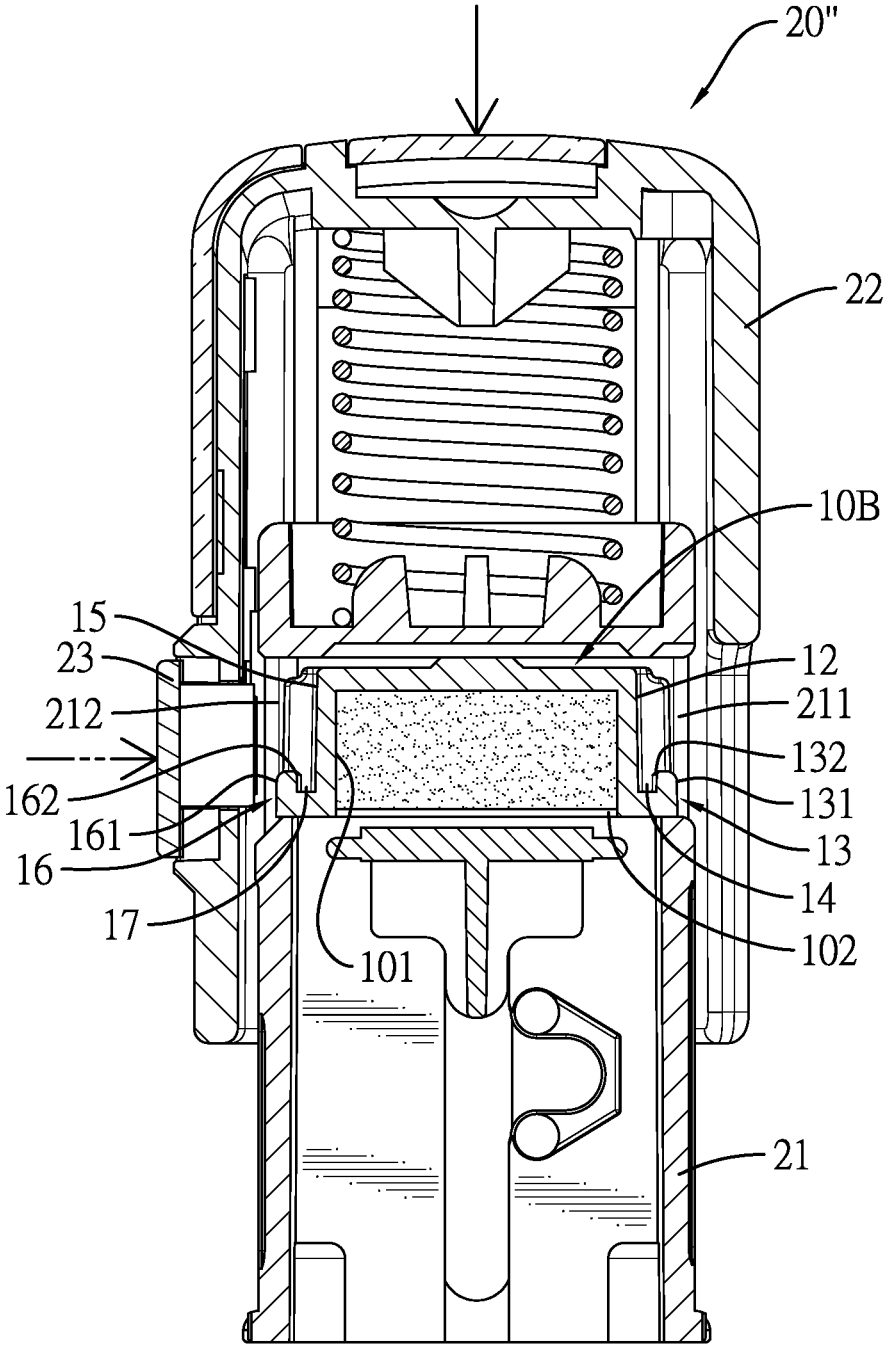
FIG. 20 is an operational cross sectional side view of the stamp in FIG. 17 showing that a body of the ink pad container is pushed by a pushing device of the stamp.
Figure 21:
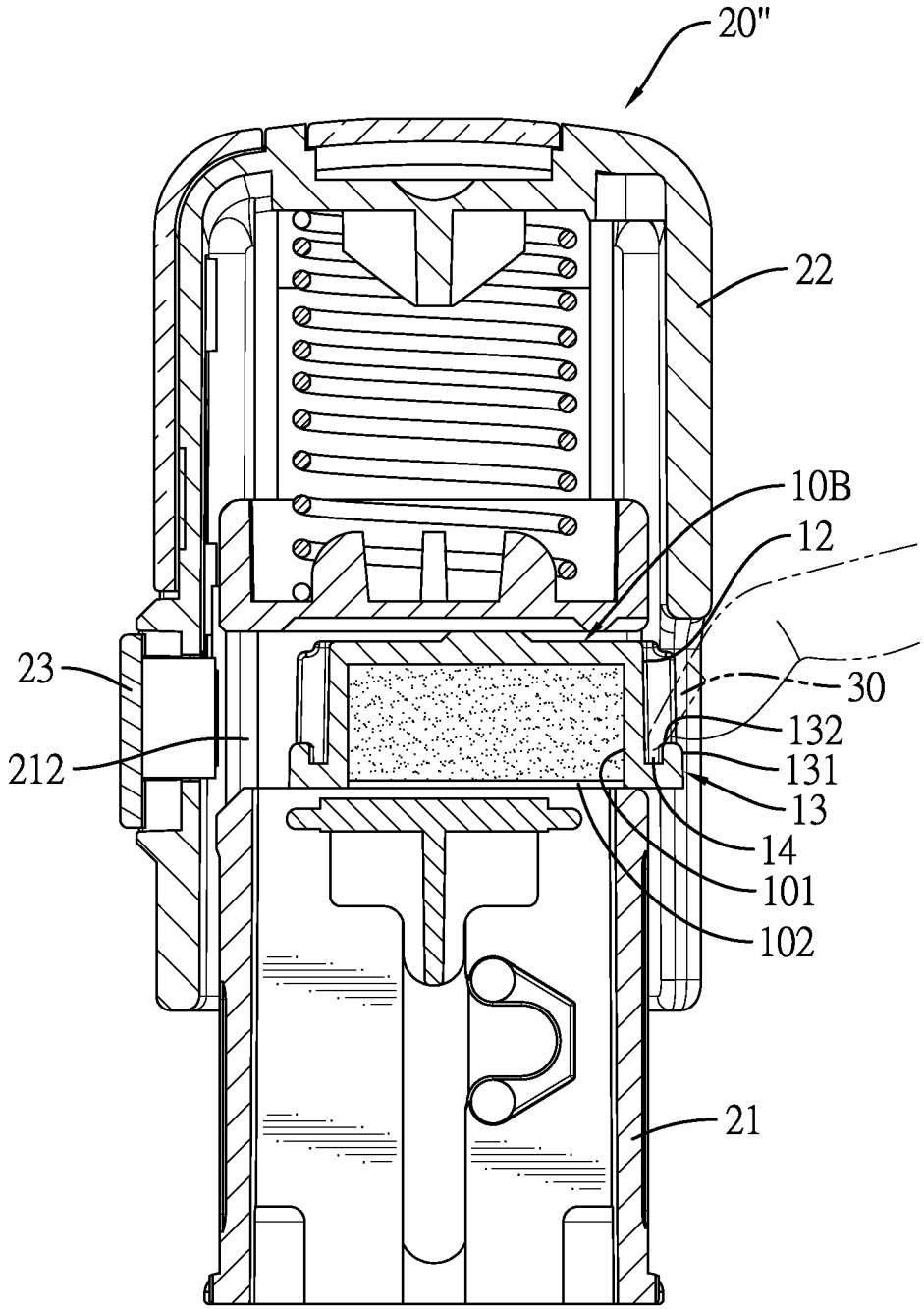
FIG. 21 is an operational cross sectional side view of the stamp in FIG. 17 showing that a body of the ink pad container is pulled.

With reference to FIGS. 20 and 21, during replacement, firstly, the moving seat 22 can be pressed downwardly. The pushing device 23 driven by the moving seat 22 moves downwardly and faces the second convex surface 161 of the rear stopper 16 of the body 10B. The user can push the pushing device 23, and then the pushing device 23 abuts against and pushes the second convex surface 161 of the rear stopper 16 of the body 10B, so that the body 10B can move forwardly and be protruded out of the front insertion opening 211 slightly. The nail 30 of the user can be inserted into the front guiding groove 14 and abuts the first guiding surface 132 of the front stopper 13 for forcing to pull out the body 10B with the single-point forcing.

Alternatively, the nail 30 of the user can be inserted into the front guiding groove 14 and abuts the first guiding surface 132 of the front stopper 13 for forcing to pull out the body 10B without firstly forcing on the second convex surface 161 of the rear stopper 16.

Accordingly, the single front stopper 13 is formed on the front surface of the body 10A, 10B, 10C, 10D, 10E, 10F. The nail 30 of the user can be inserted into the front guiding groove 14 and abuts the front stopper 13. The body 10A, 10B, 10C, 10D, 10E, 10F can be pulled smoothly with single-point forcing. The single point forcing can improve the rotation caused by the different forces in the two-point forcing. The replacement of the ink pad container is convenient and stable by the single-point forcing. The choices of the replacement operations in the ink pad container are increased by the installment of the rear stopper 16. In addition, the ink pad container can be applied to multiple embodiments of the stamps 20, 20', 20", so the applicability of the ink pad container is good.

What is claimed is:

1. An ink pad container detachably disposed on a fixing seat of a stamp, the ink pad container comprising:

a body having
- a chamber formed in the body;
- a bottom surface;
- two opposite side surfaces;
- a front surface;

an opening formed in the bottom surface of the body and communicating with the chamber;

two positioning portions formed in the two opposite side surfaces of the body respectively;

a front recess formed in the front surface of the body;

a front stopper formed across the front recess of the body;

a front guiding groove formed between the front stopper and the front recess;

a rear surface;

a rear recess formed in the rear surface of the body;

a rear stopper formed across the rear recess of the body opposite to the front stopper; and a rear guiding groove formed between the rear stopper and the rear recess.

2. The ink pad container as claimed in claim 1, wherein the front stopper is located at a middle of the front surface of the body.

3. The ink pad container as claimed in claim 2, wherein the front stopper is adjacent to one of a top surface and the bottom surface of the body.

4. The ink pad container as claimed in claim 1, wherein the front stopper is adjacent to one of a top surface and the bottom surface of the body.

5. The ink pad container as claimed in claim 1, wherein the front stopper is located at a middle of the front surface of the body, and the rear stopper is located at a middle of the rear surface of the body.

6. The ink pad container as claimed in claim 5, wherein the front stopper and the rear stopper both are adjacent to one of a top surface and the bottom surface of the body.

7. The ink pad container as claimed in claim 5, wherein the front stopper has a first convex surface formed on an outer surface of the front stopper, and the rear stopper has a second convex surface formed on an outer surface of the rear stopper.

8. The ink pad container as claimed in claim 5, wherein an inner surface of the front stopper is flat.

9. The ink pad container as claimed in claim 1, wherein the front stopper and the rear stopper both are adjacent to one of a top surface and the bottom surface of the body.

10. The ink pad container as claimed in claim 1, wherein the front stopper has a first convex surface formed on an outer surface of the front stopper, and the rear stopper has a second convex surface formed on an outer surface of the rear stopper.

11. The ink pad container as claimed in claim 10, wherein the first convex surface is located at a middle of the outer surface of the front stopper, and the second convex surface is located at a middle of the outer surface of the rear stopper.

12. The ink pad container as claimed in claim 11, wherein the front stopper has a first concave surface formed on an inner surface of the front stopper, and the rear stopper has a second concave surface formed on an inner surface of the rear stopper.

13. The ink pad container as claimed in claim 10, wherein two ends of the first convex surface are respectively adjacent to two ends of the front stopper, and two ends of the second convex surface are respectively adjacent to two ends of the rear stopper.

14. The ink pad container as claimed in claim 10, wherein the front stopper has a first guiding surface formed on an inner surface of the front stopper, the first guiding surface is inclined outwardly with respect to the body, the rear stopper has a second guiding surface formed on an inner surface of the rear stopper, and the second guiding surface is inclined outwardly with respect to the body.

15. The ink pad container as claimed in claim 1, wherein an inner surface of the front stopper is flat.

* * * * *